US011820481B2

(12) United States Patent
Bondesson et al.

(10) Patent No.: US 11,820,481 B2
(45) Date of Patent: Nov. 21, 2023

(54) JOYSTICK DEVICE FOR A MARINE VESSEL

(71) Applicant: VOLVO PENTA CORPORATION, Gothenburg (SE)

(72) Inventors: Anders Bondesson, Gothenburg (SE); Katarina Hammar, Vallda (SE); Anders Thorin, Hindås (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 516 days.

(21) Appl. No.: 17/053,644

(22) PCT Filed: May 11, 2018

(86) PCT No.: PCT/EP2018/062196
§ 371 (c)(1),
(2) Date: Nov. 6, 2020

(87) PCT Pub. No.: WO2019/214829
PCT Pub. Date: Nov. 14, 2019

(65) Prior Publication Data

US 2021/0070414 A1 Mar. 11, 2021

(51) Int. Cl.
*B63H 21/21* (2006.01)
*G05G 9/047* (2006.01)

(52) U.S. Cl.
CPC ..... *B63H 21/213* (2013.01); *G05G 9/047* (2013.01)

(58) Field of Classification Search
CPC ..... B63H 21/213; G05G 9/047
See application file for complete search history.

(56) References Cited

U.S. PATENT DOCUMENTS 3,925,414 A 12/1975 Landis et al.
6,511,354 B1 * 1/2003 Gonring ..... B63H 25/02 440/87
7,467,595 B1 * 12/2008 Lanyi ..... B63H 25/02 114/144 R
7,575,491 B1 * 8/2009 Martin ..... B63H 21/213 440/87

(Continued)

FOREIGN PATENT DOCUMENTS

EP 3006327 A1 4/2016
JP 2010126085 A 6/2010

(Continued)

OTHER PUBLICATIONS

Chinese Office Action dated Jan. 30, 2022 in corresponding Chinese Patent Application No. 201880093188.5, 16 pages.

(Continued)

*Primary Examiner* — S. Joseph Morano
*Assistant Examiner* — Jovon E Hayes
(74) *Attorney, Agent, or Firm* — Venable LLP; Jeffri A. Kaminski

(57) ABSTRACT

The present disclosure generally relates to a joystick device (100) operable to provide speed, direction and steering commands for controlling a marine vessel (300). The present disclosure also relates to a marine propulsion control system controlling a set of propulsion units (308, 310, 312 and 314) carried by a hull of a marine vessel (300), wherein the marine propulsion control system is adapted to receive an input command from such a joystick device (100).

20 Claims, 3 Drawing Sheets

(56) References Cited

U.S. PATENT DOCUMENTS

| | | | | |
|---|---|---|---|---|
| 8,925,414 | B1 * | 1/2015 | Park | B63H 21/21 74/543 |
| 9,039,468 | B1 * | 5/2015 | Arbuckle | B63H 25/04 440/79 |
| 9,114,865 | B1 * | 8/2015 | Gonring | B63H 21/213 |
| 9,162,744 | B2 * | 10/2015 | Hitachi | B63H 25/42 |
| 9,266,594 | B2 * | 2/2016 | Lindeborg | B63H 20/00 |
| 9,387,916 | B2 * | 7/2016 | Skauen | B63H 25/42 |
| 9,545,987 | B1 * | 1/2017 | Przybyl | B63H 21/21 |
| 9,556,806 | B1 * | 1/2017 | O'Brien | B63H 21/213 |
| 9,828,080 | B1 * | 11/2017 | Belter | B63H 21/22 |
| 2008/0189001 | A1 * | 8/2008 | Morvillo | B63H 11/117 440/87 |
| 2010/0235023 | A1 * | 9/2010 | Kern | B63H 21/213 701/21 |

FOREIGN PATENT DOCUMENTS

| | | | |
|---|---|---|---|
| JP | 2011140272 | A | 7/2011 |
| WO | 2017202458 | A1 | 11/2017 |

OTHER PUBLICATIONS

International Search Report and Written Opinion dated Jan. 9, 2019 in corresponding International PCT Application No. PCT/EP2018/062196, 8 pages.

European Office Action dated Jul. 4, 2023 in corresponding European Patent Application No. 18725157.4, 5 pages.

* cited by examiner

JOYSTICK DEVICE FOR A MARINE VESSEL

CROSS-REFERENCE TO RELATED APPLICATIONS

This application is a U.S. National Stage application of PCT/EP2018/062196, filed May 11, 2018, and published on Nov. 14, 2019, as WO 2019/214829 A1, all of which is hereby incorporated by reference in its entirety.

TECHNICAL FIELD

The present disclosure generally relates to a joystick device operable to provide speed, direction and steering commands for controlling a marine vessel. The present disclosure also relates to a marine propulsion control system controlling a set of propulsion units carried by a hull of a marine vessel, wherein the marine propulsion control system is adapted to receive an input command from such a joystick device.

BACKGROUND

Today's marine vessels are often equipped with a plurality of propulsion units for driving the vessel. In a typical implementation, the marine vessel comprises a steering wheel for controlling a direction of the marine vessel and at least one thrust regulator for controlling a speed and direction of the propulsion units. In addition, it has been proposed, e.g. in U.S. Pat. No. 9,266,594, to additionally use a joystick device for allowing docking of the marine vessel.

To further simplify marine vessel operation, it has been proposed to combine the functionality of the steering wheel, the thrust regulator and the joystick into a single "boat maneuvering joystick", as is exemplified in U.S. Pat. No. 9,387,916. The boat maneuvering joystick disclosed in U.S. Pat. No. 9,387,916 comprises a base with sensors arranged for detecting a position of the maneuvering joystick. The maneuvering joystick comprises a first bidirectional control knob and a second bidirectional control knob, arranged movably relative each other. The maneuvering joystick also comprises first control sensors detecting a first position of the first bidirectional control knob and second control sensors detecting a second position of the stern control knob.

Accordingly, by means of U.S. Pat. No. 9,387,916 it is possible for a helmsperson to solely concentrate on a single device for operating the marine vessel. However, the solution presented in U.S. Pat. No. 9,387,916 is cluttered with buttons and knobs for achieving the desired "combinatory effect" (i.e. combination of steering wheel, thrust regulator and docking joystick), whereby operation of the marine vessel by the e.g. an inexperienced helmsperson will be overly complicated.

Accordingly, there appears to be room for further improvements in regards to joysticks adapted for providing the mentioned combinatory effect, specifically focused on achieving an overall simplified interface for operating a marine vessel.

SUMMARY

In accordance to another aspect of the present disclosure, the above is at least partly alleviated by means of a joystick device operable to provide speed, direction and steering commands for controlling a marine vessel, the joystick device having a movable steering member extending on an axis and adapted to be tilted from a neutral position in at least four directions including a forward, a rearward, a leftward, and a rightward direction, wherein the joystick device is adapted to selectively operate in one of a first mode and a second mode, wherein the movable steering member is adapted to be self-centered to the neutral position from all directions of inclination when in the first mode, and the movable steering member is adapted to be self-centered to the neutral position from all directions of inclination, except the forward and backward direction, when in the second mode.

In accordance to the present disclosure, the idea is to allow for a simplified operation of the joystick device for controlling a marine vessel, with the focus on an appeared seamless transition from e.g. a docking operation for the marine vessel (corresponding to the first mode) to a general e.g. "high speed" operation of the marine vessel. Thus, in line with the present disclosure, the function of the joystick device will change dependent on in which mode the marine vessel is to be operated. That is, in the first mode the joystick will be adapted to be self-centered from all directions, thus not "sticking" in a forward or backward direction (inclination) of the movable steering member as will be the case in the second mode.

Advantages' following the present disclosure is the possibility to simplify the overall handling of the marine vessel, whereby operation is inherently adapted based on a current situation for handling the marine vessel. That is, in the above mentioned normal operational mode, e.g. the high-speed mode (second mode), the helmsperson may be allowed to arrange the movable steering member at a desirable forward or backward inclination, meaning that the marine vessel will move forward/backward (typically with a speed related to a level of inclination of the movable steering member) even if the helmsperson is not actively holding his hand at the movable steering member in the desired inclination. Conversely, when e.g. docking the marine vessel (first mode), the helmsperson will have to actively operate/incline the movable steering member at a desirable inclination (any direction), otherwise the movable steering member will self-center back to the neutral position whereby a trust provided by the propulsion units in some embodiments may be set to zero.

It should however be understood that the neutral position not necessarily may result in the trust provided by the propulsion units is set to zero. Rather, in some embodiments it may be possible that the neutral positions relate to a predetermined "geographical position", such as a GPS position, where e.g. the helmsperson has a desire that the vessel should stay (such as during a fishing expedition). As such, the neutral position may still result in that some thrust is provided by some of the propulsion units to counter e.g. currents and wind such that the vessel "stands still".

In line with the above discussion, in accordance to the present disclosure, the movable steering member may in one embodiment be adapted to be tilted from the neutral position in an arbitrary direction including the forward, the rearward, the leftward, and the rightward direction. As such, independent on if the joystick device is in the first or the second mode; the joystick may be used for controlling direction of the vessel not being just a forward or backward direction.

Furthermore, it may in some embodiments of the present disclosure be possible to allow the movable steering member to be rotatable around the axis for providing rotational commands for controlling the marine vessel. That is, the joystick device may in such an embodiment advantageously be used for "twisting" the marine vessel (yaw). Specifically, by rotating/twisting the movable steering member, the marine vessel is controlled to rotate/twist. The twisting/rotating action may preferable be allowed to be performed both in a clockwise and an anti-clockwise manner, thus rotating/twisting the vessel in a corresponding manner.

It is further preferred to implement the twisting/rotating of the movable steering member such that the movable steering member automatically may return back to a rotational neutral position thereof, e.g. once the helmsperson lets go of the movable steering member. Such an implementation may for example comprise one of a plurality of springs for achieving the return function.

It should however be understood that it in some embodiments may be preferred to only allow the rotation/twisting to take place when the joystick device is in the first mode. That is, in case the second mode is the above exemplified high-speed mode, such a yaw operation may be undesirable and may result in an undesirable wear on the propulsion units as well as related control equipment comprised with the vessel.

That said, it may however in some situations be allowed to perform the twisting action also in the second mode, possibly implemented in a slightly different manner for achieving a rotational motion of the vessel in some operational situations.

Dependent on the desired implementation of the joystick device, it may in some embodiments be desirable to only allow the transition between the first and the second mode to take place when the movable steering member is arranged in the neutral position. That is, such an implementation may effectively allow for undesirable maneuvers to take place in case e.g. the helmsperson unintentionally switch between the first and the second mode. Using the proposed transitional limitation, it may be possible to ensure that the speed of travel for the marine vessel is reduced when transitioning between the separate modes.

In an embodiment of the present disclosure, the joystick device further comprises an electronic processing circuit adapted to receive an indication of a desire to transition between the first and the second mode, and control mechanical means for arranging the movable steering member in the first mode or the second mode dependent on a state of the indication. This will be further elaborated below in the detailed description of the present disclosure.

In a further embodiment of the present disclosure, it may be possible to provide the joystick device with feedback means adapted to create a haptic effect perceivable at the movable steering member. Accordingly, depending on e.g. the direction of inclination of the movable steering member (such as at an end position in regards to inclination), the helmsperson holding e.g. a hand at the movable steering member may be given feedback, typically without the helmsperson having to look at the movable steering member for determining in what direction the movable steering member is inclined. The haptic effect may also be provided for different purposes, e.g. for indicating an upcoming obstacle in case the vessel is to continue to move in the current direction, etc., based on e.g. information received from another control system comprised with the vessel.

According to another aspect of the present disclosure, there is provided a marine propulsion control system controlling a set of propulsion units carried by a hull of a marine vessel, the marine propulsion control system comprising a control unit configured to receive an input command from a joystick device according to any one of the preceding claims, and provide a set of control commands for controlling a desired delivered thrust, gear selection and steering angle for the set of propulsion units. This aspect of the present disclosure provides similar advantages as discussed above in relation to the previous aspect of the present disclosure.

The marine propulsion control system may in turn be comprised with a marine vessel, further comprising a set of propulsion units and a joystick device as discussed above. Any number of propulsion units may be comprised with the marine vessel, such as e.g. at least a first and a second. Further propulsion units may for example be included, such as e.g. a bow thruster.

Further advantages and advantageous features of the present disclosure are disclosed in the following description and in the dependent claims.

BRIEF DESCRIPTION OF THE DRAWINGS

With reference to the appended drawings, below follows a more detailed description of embodiments of the present disclosure cited as examples.

In the drawings.

DETAILED DESCRIPTION

Figure 1:
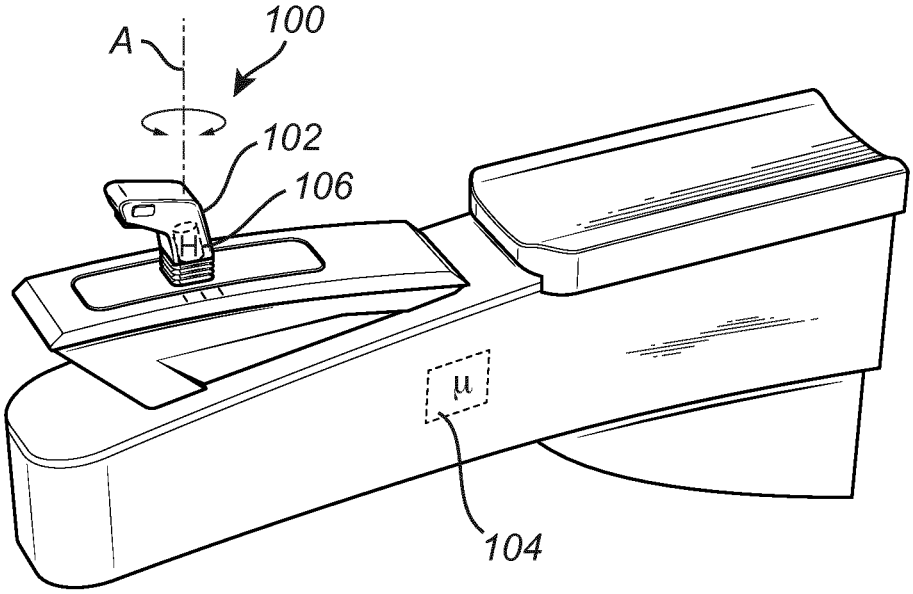
FIG. 1 conceptually illustrates a joystick device according to the present disclosure.

The present disclosure will now be described more fully hereinafter with reference to the accompanying drawings, in which currently preferred embodiments of the present disclosure are shown. This disclosure may, however, be embodied in many different forms and should not be construed as limited to the embodiments set forth herein; rather, these embodiments are provided for thoroughness and completeness, and fully convey the scope of the disclosure to the skilled addressee. Like reference characters refer to like elements throughout.

Referring now to the drawings and to FIG. 1 in particular, there is conceptually depicted a joystick device 100 adapted for controlling a marine vessel. The joystick device 100 comprises a movable steering member 102 extending on an axis and adapted to be tilted from a neutral position in at least four directions including a forward, a rearward, a leftward, and a rightward direction. Thus, the tilting direction of the movable steering member 102 is used for issuing commands for use in at least forward or reverse surge, left or right sway movement of the vessel. It should however be understood that the movable steering member 102 in some embodiments may be tilted/inclined in any direction, such as in between the forward and leftward direction, etc.

Moreover, the movable steering member 102 may also be rotatably operated so as to issue an operating instruction for achieving a yaw movement of the vessel. In one embodiment this is accomplished by rotating the movable steering member 102 about its vertical axis, A. When the movable steering member 102 is altered from a neutral position, a detection signal is transmitted to a control unit 104. For example, when a helmsperson (or other operator) tilts the joystick to the port side and rotates it clockwise the propulsion units are controlled such that a hull of the vessel moves in a sway movement translational to the port side with a clockwise rotation.

Furthermore, it should be understood that the level of inclination, possibly dependent on if the joystick device 100 is arranged in the first or the second mode, may determine the level of trust to be provided for moving the vessel. That is, an increasing inclination of the movable steering member 102 corresponds to a comparable increase of the speed for movement of the vessel. The relation may possibly, but not necessarily, be linear. The joystick device 100 may for example comprise sensors (not shown) or other means for detecting a position of the movable steering member 102, such as the current inclination of the movable steering member 102.

The joystick device 100 further comprises feedback means 106 adapted to create a haptic effect perceivable at the movable steering member 102. Such feedback may for example appear when the movable steering member 102 has been pushed as far as possible to an "end tilting position". Such a feedback may also be provided e.g. "just before" a gear is engaged or changed.

Figure 2A:
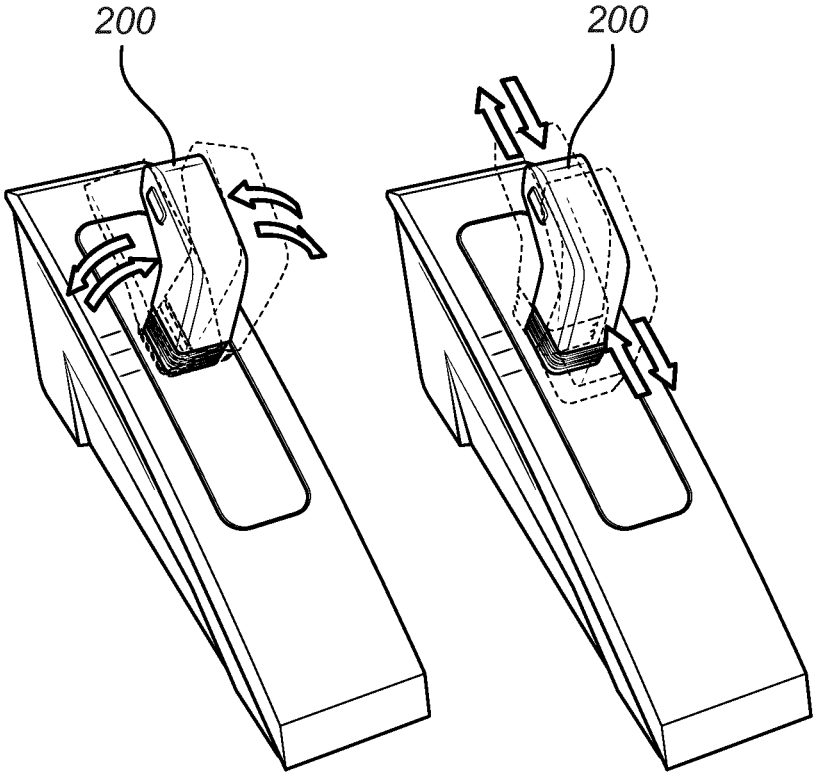
FIGS. 2A and 2B provides illustrative examples of the operation of the joystick device, and FIG. 3 exemplifies a marine vessel comprising a marine propulsion control system for operating the marine vessel using the joystick device of FIG. 1.
Figure 2B:
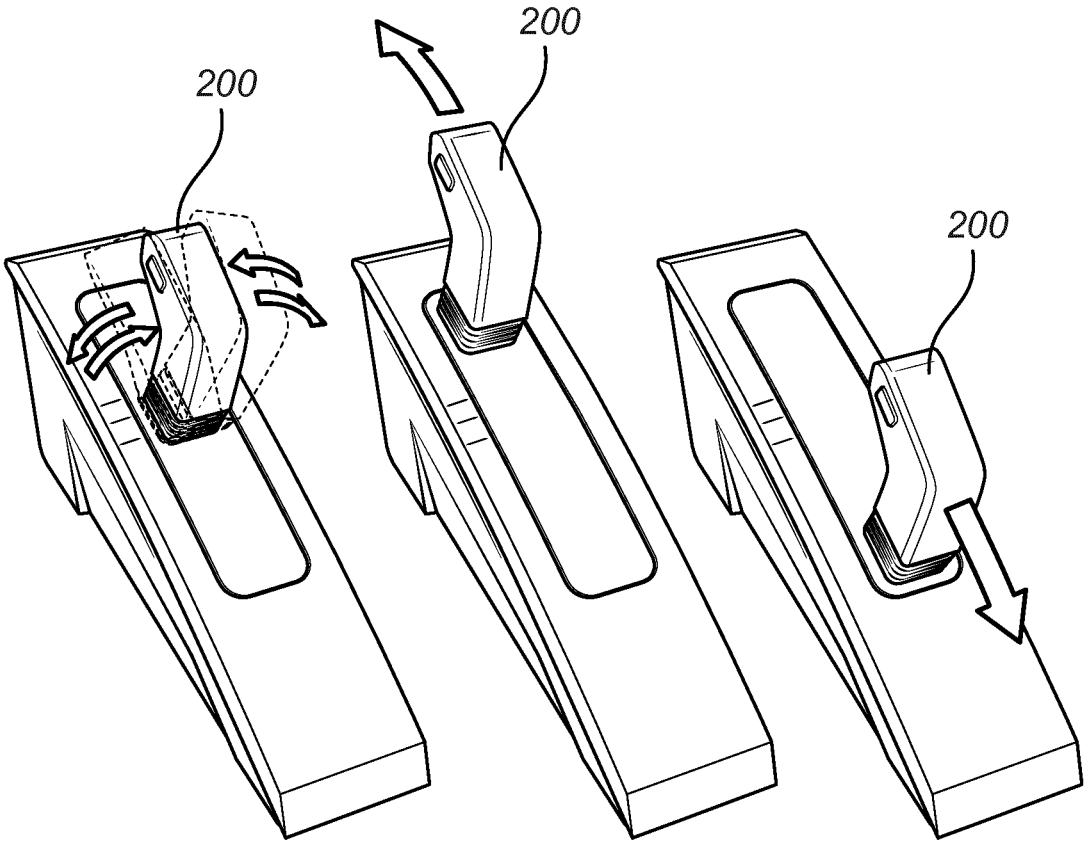

During operation of the joystick device 100, with further reference to FIGS. 2A and 2B, the joystick device 100 may be controlled in a first or a second mode. As previously discussed, the first mode may for example correspond to a docking mode, where the vessel is intended to be operated at a low speed for high controllability, where a low speed mode e.g. is when the vessel is operated below five knots. Conversely, when the joystick device 100 is arranged in the second mode, the vessel may for example be adapted to be "normally operated", such as at a higher speed as compared to when the joystick device 100 is arranged in the first mode.

With reference to FIG. 2A, an exemplifying illustration is provided of the operation of the joystick device 100 when the joystick device 100 is arranged in the first mode. As indicated above, when the joystick device 100 is arranged in the first mode, the movable steering member 102 is adapted to be self-centered to a neutral position 200 from all directions of inclination, as is a normal and well-known operation of a joystick device. That is, once e.g. the helmsperson let go of the movable steering member 102, the movable steering member 102 will automatically and accurately return to its neutral (center) position. This may for example be achieved using plurality of springs. As also indicated above, this first mode is typically used for docking operation of the vessel at a low speed, such as e.g. below five knots.

Turning now to FIG. 2B, there is provided an exemplifying illustration of the operation of the joystick device 100 when the joystick device 100 is arranged in the second mode. In this second mode, e.g. the springs used for centering the movable steering member 102 to the neutral position 200 are selectively "deactivated" insofar as regarding the self-centering function. Thus, when the helmsperson let go of the movable steering member 102, the movable steering member 102 is either forced forward or backward. That is, when in the second mode and the helmsperson let go of the movable steering member 102, when the movable steering member 102 is positioned in either of the forward and backward direction, the movable steering member 102 will stay at the same level of inclination. Accordingly, the helmsperson may in the second mode be allowed to "leave" the joystick device 100 in e.g. the forward direction and proceed with other duties when operating the vessel, thereby not having to keep his hand at the movable steering member 102.

In some embodiments of the present disclosure it may be possible to allow the joystick device 100 to comprise e.g. a "button" (not shown) for allowing the helmsperson to indicate if the joystick device 100 is to be in the first or the second mode.

However, it may in accordance to the present disclosure be possible to allow the transition from the first to the second mode to take place based on other "non-helmsperson" initiated input. That is, the transition between the first and the second mode may for example take place in case it is determined, e.g. by an electronic control unit (ECU) comprised with the vessel and a GPS receiver, that the vessel travels above a predetermined speed. For example, in case the ECU determines that the vessel travels above e.g. five knots (should be understood as a non-limiting example), the joystick device 100 may automatically transition from the first to the second mode. The transition may also (or alternatively) be location based (docking zone, map based) or time based.

Figure 3:
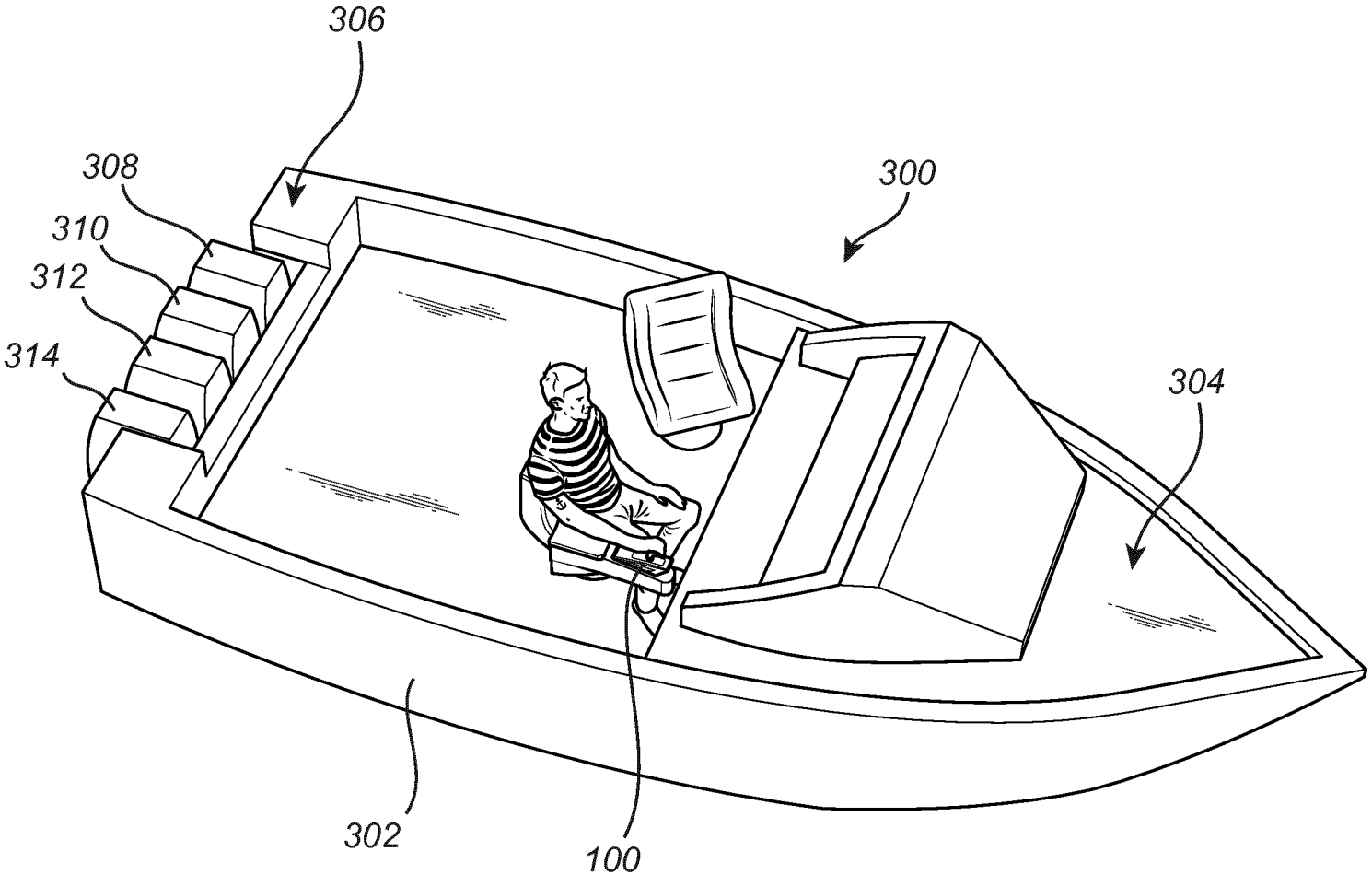

Turning finally to FIG. 3, there shown an example of a marine vessel 300 comprising a marine propulsion control system for operating the marine vessel using the above-mentioned joystick device 100.

In the illustration provided, the vessel 300 is designed with a hull 302 having a bow 304, a stern 306. In the stern 306, four propulsion units 308, 310, 312 and 314 may be mounted. The propulsion units 308, 310, 312 and 314 may be pivotally arranged in relation to the hull 302 for generating a driving thrust in a desired direction of a generally conventional kind. The propulsion units may alternatively be inboard propulsion units, mounted under the vessel on the hull 302, or mourned on the stern 306 as so called stem-drives. That is, the propulsion units 308, 310, 312 and 314 may be outboard propulsion units or inboard propulsion units.

It should be understood that the vessel 300 may be provided with more than four (or less) propulsion units. Furthermore, the vessel 300 may be provided with e.g. a bow thruster (not shown) for assisting in "moving" the bow 304, e.g. in windy situations. The 308, 310, 312 and 314, as well as the bow thruster, are operated based on the commands generated when tilting and/or rotating the movable steering member 102 in a manner as discussed above.

The processor may be or include any number of hardware components for conducting data or signal processing or for executing computer code stored in memory. The memory may be one or more devices for storing data and/or computer code for completing or facilitating the various methods described in the present description. The memory may include volatile memory or non-volatile memory. The memory may include database components, object code components, script components, or any other type of information structure for supporting the various activities of the present description. According to an exemplary embodiment, any distributed or local memory device may be utilized with the systems and methods of this description. According to an exemplary embodiment the memory is communicably connected to the processor (e.g., via a circuit or any other wired, wireless, or network connection) and includes computer code for executing one or more processes described herein.

The present disclosure contemplates methods, devices and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor.

By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data that cause a general-purpose computer, special purpose computer, or special purpose processing machines to perform a certain function or group of functions.

Although the figures may show a specific order of method steps, the order of the steps may differ from what is depicted. In addition, two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps and decision steps. Additionally, even though the disclosure has been described with reference to specific exemplifying embodiments thereof, many different alterations, modifications and the like will become apparent for those skilled in the art.

Variations to the disclosed embodiments can be understood and effected by the skilled addressee in practicing the claimed disclosure, from a study of the drawings, the disclosure, and the appended claims. Furthermore, in the claims, the word "comprising" does not exclude other elements or steps, and the indefinite article "a" or "an" does not exclude a plurality.

The invention claimed is:

1. A joystick device operable to provide speed, direction and steering commands for controlling a marine vessel, the joystick device having a movable steering member extending on an axis and adapted to be tilted from a neutral position in at least four directions including a forward, a rearward, a leftward, and a rightward direction, wherein the joystick device is adapted to selectively operate in one of a first mode and a second mode, wherein:

the movable steering member is adapted to be self-centered to the neutral position from all directions of inclination when in the first mode, the movable steering member is adapted to be self-centered to the neutral position from all directions of inclination, except forward and backward directions, when in the second mode, the movable steering member is rotatable around the axis for providing rotational commands for controlling the marine vessel, and the movable steering member is rotatable only in the first mode.

2. The joystick device according to claim 1, wherein the movable steering member is adapted to be tilted from the neutral position in an arbitrary direction including the forward, the rearward, the leftward, and the rightward direction.

3. The joystick device according to claim 1, wherein the movable steering member is rotatable in the first mode and in the second mode.

4. The joystick device according to claim 1, wherein the first mode is a low speed drive mode and the second mode is a high-speed drive mode.

5. The joystick device according to claim 1, wherein the first mode is a docking mode and the second mode is a drive mode.

6. The joystick device according to claim 1, wherein the joystick device is adapted to transition between the first and the second mode only when the movable steering member is arranged in the neutral position.

7. The joystick device according to claim 1, further comprising a processing circuit adapted to: receive an indication of a desire to transition between the first and the second mode, and control mechanical means for arranging the movable steering member in the first mode or the second mode dependent on a state of the indication.

8. The joystick device according to claim 7, further comprising feedback means adapted to create a haptic effect perceivable at the movable steering member.

9. The joystick device according to claim 8, wherein the feedback means is operated dependent on a predetermined position of the movable steering member.

10. The joystick device according to claim 9, wherein the predetermined position is an end position for the movable steering member.

11. The joystick device according to claim 9, wherein the predetermined position is at least one of an idle forward, an idle reverse position or the neutral position for the movable steering member.

12. A marine propulsion control system controlling a set of propulsion units carried by a hull of a marine vessel, the marine propulsion control system comprising a control unit configured to: receive an input command from a joystick device according to claim 1, and provide a set of control commands for controlling a desired delivered thrust, gear selection and steering angle for the set of propulsion units.

13. A marine vessel, comprising: a set of propulsion units, and a marine propulsion control system according to claim 12, and a joystick device according to claim 1.

14. The marine vessel according to claim 13, wherein the set of propulsion units comprises at least a first and a second propulsion unit.

15. A joystick device operable to provide speed, direction and steering commands for controlling a marine vessel, the joystick device having a movable steering member extending on an axis and adapted to be tilted from a neutral position in at least four directions including a forward, a rearward, a leftward, and a rightward direction, wherein the joystick device is adapted to selectively operate in one of a first mode and a second mode, wherein:

the movable steering member is adapted to be self-centered to the neutral position from all directions of inclination when in the first mode, the movable steering member is adapted to be self-centered to the neutral position from all directions of inclination, except forward and backward directions, when in the second mode, and the joystick device further comprises a processing circuit adapted to:

receive an indication of a desire to transition between the first and the second mode, and control mechanical means for arranging the movable steering member in the first mode or the second mode dependent on a state of the indication.

16. The joystick device according to claim 15, wherein the movable steering member is adapted to be tilted from the neutral position in an arbitrary direction including the forward, the rearward, the leftward, and the rightward direction.

17. The joystick device according to claim 15, wherein the first mode is a low speed drive mode and the second mode is a high-speed drive mode.

18. The joystick device according to claim 15, wherein the first mode is a docking mode and the second mode is a drive mode.

19. The joystick device according to claim 15, wherein the joystick device is adapted to transition between the first and the second mode only when the movable steering member is arranged in the neutral position.

20. A marine propulsion control system controlling a set of propulsion units carried by a hull of a marine vessel, the marine propulsion control system comprising a control unit configured to:

receive an input command from a joystick device according to claim 15, and provide a set of control commands for controlling a desired delivered thrust, gear selection and steering angle for the set of propulsion units.

* * * * *